United States Patent [19]

Sakaguchi

[11] 4,183,018

[45] Jan. 8, 1980

[54] MOTOR DRIVEN TYPE GONG STRIKING MECHANISM

[75] Inventor: Mitsuo Sakaguchi, Tokyo, Japan

[73] Assignee: Kobishi Electric Co., Ltd., Japan

[21] Appl. No.: 891,601

[22] Filed: Mar. 30, 1978

[30] Foreign Application Priority Data

Dec. 6, 1977 [JP] Japan ..... 52-163630[U]
Dec. 6, 1977 [JP] Japan ..... 52-163631[U]

[51] Int. Cl.[2] ..... G10K 1/064

[52] U.S. Cl. ..... 340/396; 340/392; 116/152

[58] Field of Search ..... 116/152, 155, 148, 154; 310/80; 340/392, 396, 393, 400, 402, 629, 384 E, 384 R, 390

[56] References Cited

U.S. PATENT DOCUMENTS

| | | | |
|---|---|---|---|
| 1,062,799 | 5/1913 | Rowe | 310/80 |
| 1,236,117 | 8/1917 | Smith | 116/165 |
| 1,357,915 | 11/1920 | Treanor | 116/165 |
| 2,443,559 | 6/1948 | Garcean | 116/152 |
| 2,476,055 | 7/1949 | Magdelain | 116/152 |
| 2,775,128 | 12/1956 | Young | 74/53 X |
| 2,923,164 | 2/1960 | Walsh | 74/54 |
| 2,925,584 | 2/1960 | Bonanno | 340/398 X |

*Primary Examiner*—Daniel M. Yasich
*Attorney, Agent, or Firm*—Kane, Dalsimer, Kane, Sullivan and Kurucz

[57] ABSTRACT

In a motor driven type gong striking mechanism, the rotation of the main shaft of an electric motor is converted through a crank mechanism into the oscillation of a piston plate, a gong striking hammer is coupled through a spring to the piston plate so that the hammer is oscillated, and a gong is disposed in the range of oscillation of the hammer. Thus, as a result of the rotation of the motor, the hammer is oscillated to strike the gong provided in the stroke of the hammer.

8 Claims, 14 Drawing Figures

MOTOR DRIVEN TYPE GONG STRIKING MECHANISM

BACKGROUND OF THE INVENTION

This invention relates to gong-striking mechanisms in which the rotation of an electric motor is converted into reciprocal motion to strike a gong with a hammer.

In a conventional electro-magnetic attraction type bell, as illustrated in FIG. 13, a bobbin 2 incorporating an iron core 2*a*, and a stationary contact plate 3 are fixedly secured to a yoke 1, and a vibrating plate 5 to which the base of a leaf spring 4 is fixedly secured is swingably provided. A movable contact 4*a* is provided on the end portion of the leaf spring 4, while a stationary contact 3*a* is provided on the aforementioned stationary contact plate 3. One end portion of a coil 2*b* wound on the bobbin 2 is employed as a lead wire 6, while the other end portion of the coil 2*b* is connected to the base of the leaf spring. Furthermore, a lead wire 7 is connected to the base of the stationary contact plate 3. The base of a hammer 8 is fastened to the end portion of the aforementioned vibrating plate 5, and the hammer 8 is inserted into a through-hole formed in the yoke 1. A spring 9 is provided on the hammer 8 in such a manner that it surrounds the hammer 8 and one end of the spring 9 is secured to the through-hole of the yoke 1. A gong 10 is spaced a predetermined distance from the hammer 8.

Upon application of a DC voltage across the lead wires 6 and 7 of the bell thus constructed, current flows through the lead wire 6, the coil 2*b*, the leaf spring contact 4*a* and the stationary contact 3*a* to the lead wire 7. As a result, the vibrating plate 5 is attached by the iron core 2*a*, and the hammer 8 strikes the gong 10 against the elastic force of the spring 9. At the same time, the movable contact 4*a* is disconnected from the stationary contact 3*a*, as a result of which the current is interrupted, and the vibrating plate 5 is restored or returned to its initial position by the elastic force of the spring 9. Therefore, the movable contact 4*a* is connected to the stationary contact 3*b* again, and the current is allowed to flow in the circuit. The abovedescribed operation is repeatedly carried out to ring the gong.

In the bell as described above, the number of times of striking the gong 10 with the hammer 8, which is an important factor to determine the bell sound volume, is affected by the strength of the leaf spring 4, the weight of the hammer 8, the spring constant of the spring 9, or the like. Therefore, it is difficult to determine the number of times of striking the gong per unitary time. Furthermore, since the movable contact 4*a* is disconnected from the stationary contact 3*a* immediately upon energization of the coil, it is difficult to set the stroke of the hammer 8 to a desired value. The number of times of striking the gong and the stroke of the hammer 8 may be obtained through experiments to generate the loudest sound. However, because of the above-described difficulties, it is difficult to provide a bell having the optimum number of times of striking the gong and the optimum stroke of the hammer.

In order to overcome these difficulties, a motor driven type bell has been proposed employing a small DC motor in which torque is proportional to current consumption. Such a motor driven type bell is shown in FIG. 14. In this case, the rotation of a motor 11 is transmitted through gears 12 and 13 to a cam 14. As the cam 14 is rotated, a hammer 15 oscillates.

In this system, the hammer 15 is oscillated directly by the cam 14, the motor 11 should provide a great torque, which leads to an increase of current consumption. Sometimes, the motor 11 may be burned. Thus, the system is still disadvantageous or has problems to be solved.

SUMMARY OF THE INVENTION

Accordingly, it is an object of this invention to provide a novel motor driven type gong striking mechanism in which all of the above-described drawbacks accompanying a conventional one are overcome.

Another object of the invention is to provide a novel motor driven type gong striking mechanism in which the number of times of striking a gong with a hammer and the stroke of the hammer can be controlled as desired.

A further object of the invention is to provide a novel motor driven type gong striking mechanism in which application of an excessive torque to an electric motor is prevented, thereby protecting the electric motor from burning.

The novel features which are considered characteristic of this invention are set forth in the appended claims. This invention itself, however, as well as other objects and advantages thereof will be best understood by reference to the following detailed description of illustrative embodiments, when read in conjunction with the accompanying drawings.

DETAILED DESCRIPTION OF THE INVENTION

Figure 1:
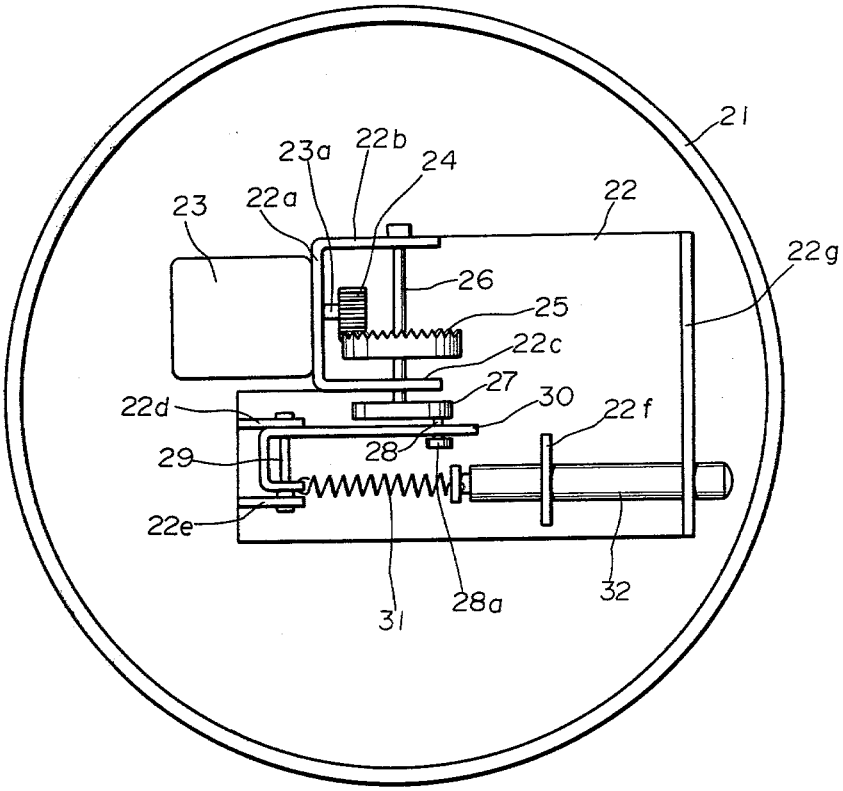
FIGS. 1 and 2 are a plan view and a sectional side view illustrating one embodiment of this invention, respectively.
Figure 2:
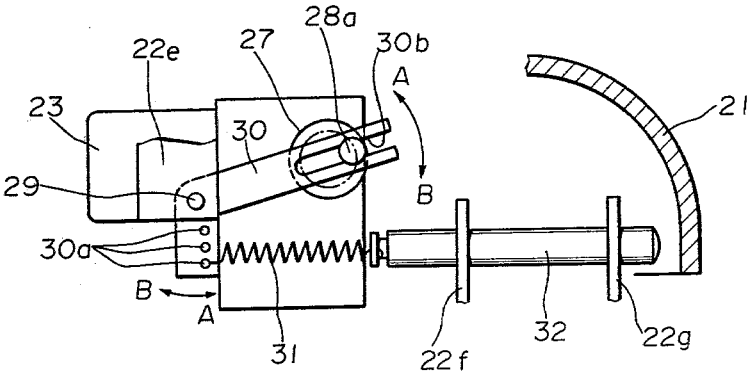

A first embodiment of this invention is shown in FIGS. 1 and 2, in which reference numeral 21 designates a gong. The gong 21 is made of iron in the form of a cup or a semisphere. A mounting section is protruded from the central portion of the inner wall of the gong 21. A frame 22 is fixedly secured to the mounting section with mounting bolts or the like. Mounted on one side wall plate 22*a* of the frame 22 is an electric motor 23, on the rotary shaft 23*a* of which a pinion gear 24 is provided. A gear 25 fixedly mounted on a shaft 26 is engaged with the pinion gear 24. The shaft 26 is inserted into two opposed wall plates, or the front wall plate 22b and the rear wall plate 22c, of the frame 22, and is rotatably supported by these wall plates 22c and 22b. A pivotally movable transmission means formed of cam elements 27, 28 and 28a transmits the rotation of the motor to piston plate 30. The front end portion of the shaft 26 is connected to a cam 27. A cam pin 28 is protruded from a position on the cam 27 which is remote a predetermined distance from the center of the cam 27. The cam pin 28 makes circular motion as the shaft 26 and accordingly the cam 27 is rotated. A fulcrum pin 29 is pivotally provided between two opposed wall plates, or the front and rear wall plates 22d and 22e, on the frame 22. Furthermore, the base of a piston plate 30 is pivotally mounted on the fulcrum pin 29. The section of the piston plate 30 is bent so as to form an obtuse angle, and a plurality of mounting holes 30a are formed at predetermined intervals in one end portion of the piston plate 30, so that a coil spring 31 is coupled to one of the holes 30a. Formed in the other end portion of the piston plate 30 is a slot 30b which engages the cam pin 28 mentioned above. A retaining piece 28a is provided on the top of the cam pin 28 so that unintentional disengagement of the piston plate 30 from the cam pin 28 is prevented. Thus, as the cam pin 28 makes circular motion, the piston plate 30 makes arc motion about the fulcrum pin 29 as a fulcrum. One end of the spring 31 is connected to one mounting hole 30a of the piston plate 30, while the other end of the spring 31 is connected to the base of a bell (gong) striking hammer 32. The hammer 32 is inserted into holes provided in an intermediate wall plate 22f and the other side wall plate 22g of the frame 22 in such a manner that it can freely move in a lateral direction. The hammer 32 is adapted to oscillate in association with the arc motion of the piston plate 30. The stroke of reciprocation of the hammer 32 can be controlled by selecting an appropriate mounting hole 30a to which the end of the spring 31 is connected.

Now, the operation of the gong striking mechanism thus constructed will be described.

Upon energization of the motor 23, its rotary shaft 23a is rotated, and the pinion gear 24 is therefore rotated. As a result, the gear 25 is rotated, and the cam 27 together with the shaft 26 is rotated. As the cam 27 is rotated, the cam pin 28 makes circular motion (as indicated by the one-dot chain line in FIG. 2), and therefore the piston plate 30 makes arc motion about the fulcrum pin 29 as a fulcrum as indicated by the arrow A–B because the piston plate 30 is pushed laterally by the cam pin 28. When the piston plate 30 is moved to the position A from the position B, the spring 31 is pushed right by the base of the piston plate, as a result of which the hammer 32 is moved right to strike the gong 21. On the other hand, when the piston plate 30 is moved to the position B from the position A, the hammer 32 is pulled left by the spring 31; that is, the hammer 32 is moved left. Thus, in association with the arc motion of the piston plate 30, the hammer 32 oscillates so that the gong 21 is repeatedly struck by the hammer 32; that is, the gong ringing state is obtained.

Figure 3:
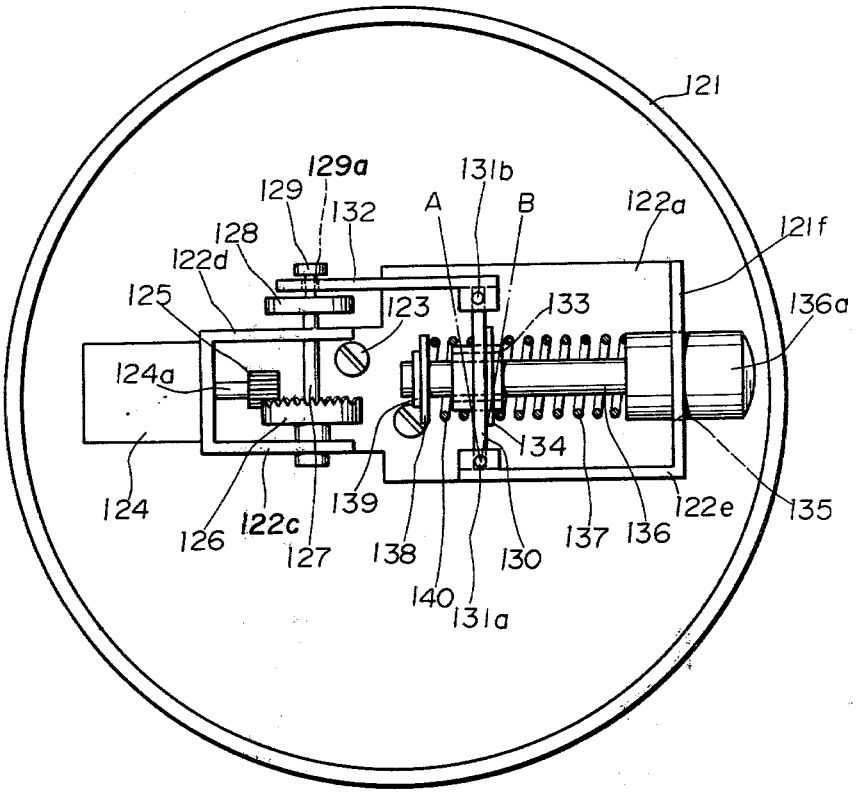
FIGS. 3, 4 and 5 are a plan view, a sectional side view, and exploded perspective view showing another embodiment of the invention.
Figure 4:
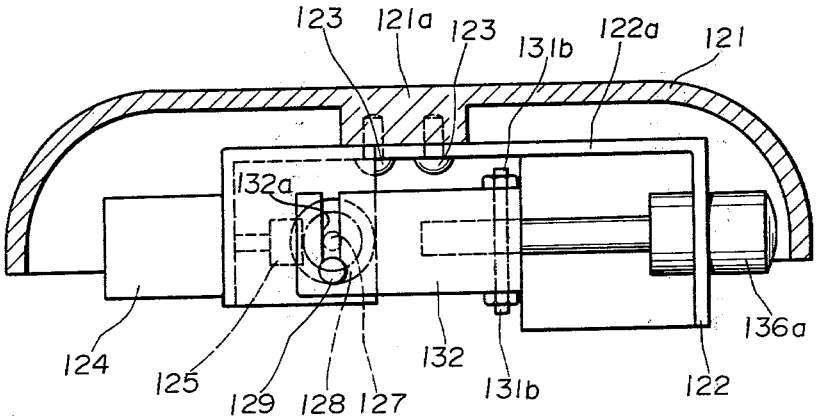
Figure 5:
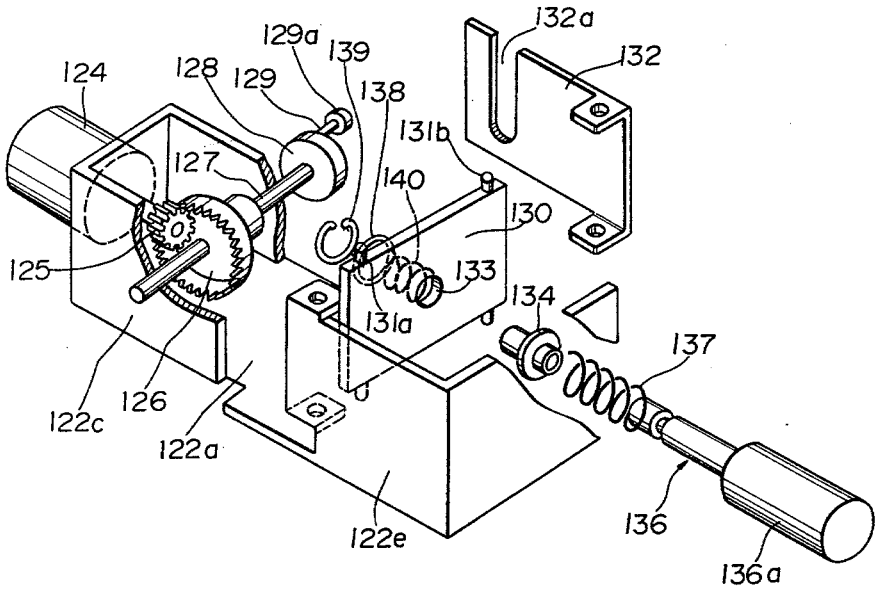

Another embodiment of the invention will be described with reference to FIGS. 3 through 5, in which reference numeral 121 designates a gong which is made of iron in the form of a cup or a semi-sphere similarly as in the first embodiment described above. Slots (not shown) are cut in the peripheral inner wall of the gong at angular intervals of about 90 degrees. The entire surface of the gong 121 is coated for rust proofing. A mounting section 121a is protruded from the central portion of the inner wall of the gong 121. The upper wall 122a of a frame 122 is fixedly secured to the mounting section 121a with mounting bolts 123. Provided on one side wall plate 122b of the frame 122 is an electric motor 124. A pinion gear 125 is mounted on the rotary shaft 124a of the motor 124. Engaged with the pinion gear 125 is a gear 126 which is fixedly mounted on a shaft 127. The shaft 127 is inserted into holes formed in front and rear wall plates 122c and 122d provided at one side of the frame 122 in such a manner that it can freely rotate. A circular cam 128 is mounted on the rear end portion of the shaft 127. A cam pin 129 is extruded from a position on the cam 128 which is remote a predetermined distance from the center of the cam 128. This cam pin 129 is adapted to make circular motion with a predetermined radius as the shaft 127 and accordingly the cam 128 is rotated. One end portion of a rectangular hammer supporting plate 130 is rotatably mounted on the end portion of the other front wall plate 122e protruded from the frame 122 by means of a fulcrum pin 131a, while the other end portion of the hammer supporting plate 130 is rotatably mounted through a fulcrum pin 131b on one end portion of a rectangular piston plate 132. An elongated slot 132a is formed in the other end portion of the piston plate 132. The cam pin 129 engages the slot 132a. A circular retaining piece 129a is provided on the top of the cam pin 129 so that unintentional disengagement of the piston plate 132 from the cam pin 129 is prevented. As the cam pin 129 makes circular motion, the piston plate 132 oscillates. In association with the oscillations of the piston plate, the hammer supporting plate 130 makes arc motion about the fulcrum pin 131a as the center. The hammer supporting plate 130 has a through-hole 133 into which a bush 134 is fitted. The provision of the bush 134 is intended to eliminate or minimize friction caused between a hammer 136 (described later) and the hammer supporting plate 130 when the hammer 136 oscillates. The other side wall plate 121f of the frame 121 has a through-hole 135 whose diameter is larger than that of the through-hole 133. The hammer 136 is inserted into this through-hole 135 and the bush 134. The hammer 136 is to strike the gong 121, and has an end portion 136a whose diameter is larger than the other portion thereof. A coil spring 137 is provided between the end portion 136a and the bush 134 in such a manner that the rod-shaped portion of the hammer is surrounded by the coil spring. A washer 138 is mounted on the rear end portion of the hammer 136 by means of a C-shaped or E-shaped ring 139. A coil spring 140 is provided between the washer 138 and the hammer supporting plate 130. The above-described spring 137 is to cause the hammer 136 to oscillates as the hammer supporting plate 130 makes arc motion. Furthermore, the spring 137 serves to absorb the reaction which is applied to the hammer supporting plate 130 when the hammer 136 strikes the gong 121 and to increase the sound of the gong by maintaining the hammer 136 depressing the gong 121 for a predetermined period of time. On the other hand, the spring 140 is to absorb the impact caused between the hammer 136 and the hammer supporting plate 130. Furthermore, the spring 140 has a function that, when the hammer 136 is moved to strike the gong 121, the force of this motion is increased by the elastic force of the spring 140, so that the hammer is moved beyond the stroke of the hammer supporting plate 130. Therefore, if the elastic force of the spring 140 is suitably selected, it is possible to make the stroke between the gong 121 and the hammer 136 longer than that in the case where the spring 140 is not provided.

The operation of the gong striking mechanism thus constructed will be described.

Upon energization of the motor 124, the rotary shaft 124*a* of the motor is rotated, and the pinion gear 125 is rotated. As a result, the gear 126 is rotated, and the cam 128 together with the shaft 127 is rotated. As the cam 128 is rotated, the cam pin 129 makes circular motion as indicated by the one-dot chain line in FIG. 4. As a result, the piston plate 132 being depressed by the cam pin 129 oscillates. In association with the oscillation of the piston plate 132, the hammer supporting plate 130 makes arc motion within a range A–B indicated by the one-dot chain lines shown in FIG. 3. As a result, the hammer 136 oscillates so that the hammer end portion 136*a* strikes the gong to make sound.

Figure 6:
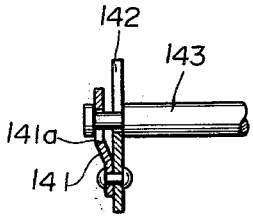
FIGS. 6 through 10 are explanatory diagrams showing various examples of a method of fixing a gong striking hammer and a hammer supporting plate in the embodiment shown in FIGS. 3 through 5.
Figure 7:
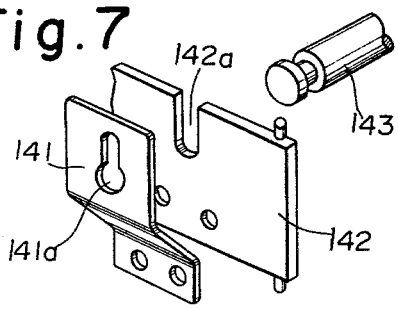

Another embodiment of the invention is shown in FIGS. 6 and 7. In this embodiment, instead of the coil spring 140 described above, a leaf spring 141 is employed. In this case, the spring 141 is mounted on a hammer supporting plate 142, and the end portion of a hammer 143 is engaged with locking holes 141*a* and 142*a* formed in the spring 141 and the hammer supporting plate 142 without fitting bushes thereinto. The other components and their functions are similar to those described in the second embodiment of the invention.

Figure 8:
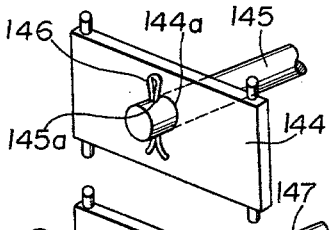

In another embodiment shown in FIG. 8, the above-described spring 140 is not provided. A hammer 145 is inserted into a through-hole 144*a* of a hammer supporting plate 144, and an elastic retaining piece 146 is inserted into a small hole cut in the hammer 145.

Figure 9:
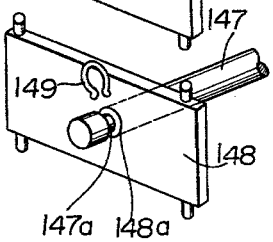

An another embodiment of the invention is shown in FIG. 9. In this embodiment, an engaging groove is formed in the end portion of a hammer 147, and the hammer 147 is inserted into a through-hole 148*a* formed in a hammer supporting plate 148. A retaining piece 149 is engaged with the engaging groove 147*a* formed on said hammer 147 at the rear end portion thereof so that the hammer 147 is supported by the hammer supporting plate 148.

Figure 10:
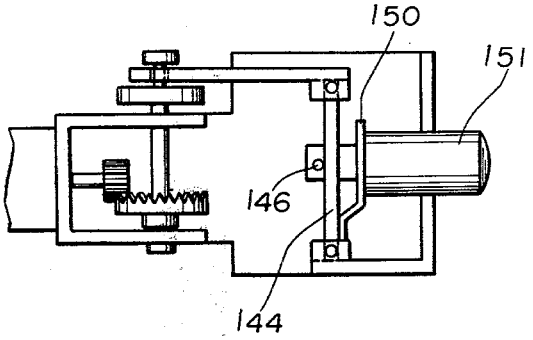

Furthermore, in another embodiment shown in FIG. 10, the above-described spring 140 is not provided, but a leaf spring 150 instead of the spring 137 is mounted on a hammer 151 and is secured to a hammer supporting plate 144. The other components are similar to those shown in FIG. 8.

Figure 11:
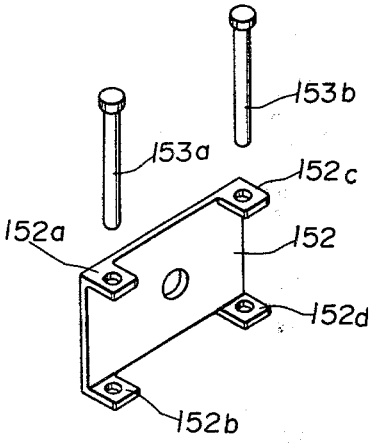
FIG. 11 is an exploded perspective view for a description of a method of mounting a hammer supporting plate on a frame.

In another embodiment of the invention shown in FIG. 11, unlike the second embodiment in which the fulcrum pins 131*a* and 131*b* are provided on the both ends of the hammer supporting plate 130, four bent portions 152*a* through 152*d* are extended from the four corners of a hammer supporting plate 15, and a center pin 153*a* and a pivot pin 153*b* are inserted respectively through-holes formed in the bent portions 152*a* and 152*b* and through-holes formed in the bent portions 152*c* and 152*d*.

Figure 12:
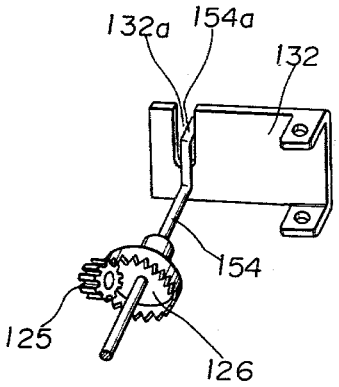
FIG. 12 is a perspective view showing one example of an assembly of a rotary shaft and a piston plate.
Figure 13:
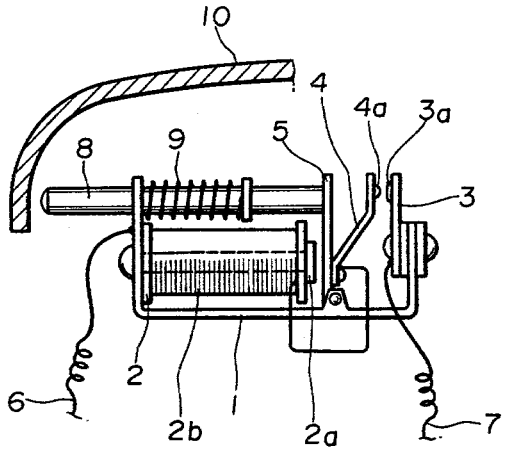
Fig. 13 (Prior Art)
FIG. 13 is a sectional side view showing one example of a conventional electro-magnetic attraction type bell.
Figure 14:
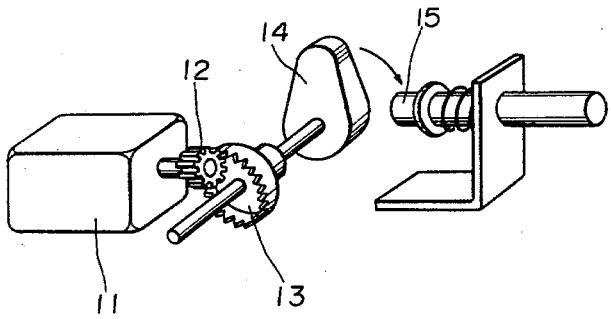
Fig. 14 (Prior Art)
FIG. 14 is a perspective view showing one example of a conventional motor driven type bell.

Another embodiment shown in FIG. 12 is different from the above-described second embodiment in which the cam 128 is mounted on the shaft 127. In this embodiment, one end portion of a shaft 154 is bent in the form of a staircase to form a bent end portion 154*a*, which is engaged with the slot 132*a* formed in the piston plate 132.

As is apparent from the above description, this invention has the following significant merits:

(1) The number of times of striking the gong with the hammer can be changed as desired by changing the speed of the motor or the gear ratio of the gears engaged for transmitting the rotation of the motor. Therefore, the number of times of striking the gong can be set to a value at which the loudest sound is generated.

(2) The strokes of the hammer can be selected as desired by changing the position of the cam pin on the cam, and the position at which the hammer passes through the hammer supporting plate.

(3) The period of time during which the hammer is abutted against the gong can be set to a optimum value by selecting the spring constants of the springs 137 and 150.

(4) By providing the springs 140 and 141 on the hammer as in the above-described embodiment, the stroke obtained in paragraph (2) can be increased. Furthermore, with respect to the excessive torque which takes place in striking the gong with the hammer, as the gong is struck through the springs, the springs serve as buffers, which leads to reduction of the electric power consumption and to elongation of the mechanical service life.

(5) If the number of times of striking the gong is controlled in accordance with the method described in paragraph (1) above, the tone color of the gong may be changed to an extent.

What is claimed is:

1. A motor driving type gong striking mechanism, which comprises:

a driving electric motor a driving electric motor mounted on a frame within a gong;

a piston plate supported on the frame and adapted to pivotally move back and forth in a substantially oscillatory motion from a first position to a second position and then back to the first postion in accordance with the rotation of the main shaft of said electric motor;

a pivotally movable transmission means for directly and continuously transmitting the rotation of the motor to said piston plate;

a hammer;

the gong spaced from the hammer and adapted to be struck by the hammer;

support means on the frame for supporting the hammer for oscillation;

spring means coupling the hammer to the piston plate for biasing and releasing such bias in response to oscillation of the piston plate to thereby cause oscillation of the hammer and cause the gong to be struck thereby.

2. The invention in accordance with claim 1, wherein the piston plate includes a pair of bifurcated arms at one end thereof and is mounted for pivotal movement with the junction of such arms, the transmission means coupling one of the arms to the output of the motor, and the spring means coupling one end of the hammer to the other end of the piston plate so that as the piston plate oscillates about its pivotal junction on the housing to bias and release the spring means so the hammer will oscillate and strike the gong.

3. The invention in accordance with claim 1, wherein the spring means includes a hammer supporting plate and a spring, the hammer supporting plate being coupled with the piston plate and being adapted to oscillate in response to oscillation of the piston plate, and the spring extending between the hammer and the hammer supporting plate such that it is adapted to be biased and released in response to oscillation of the hammer supporting plate to cause the hammer to strike the gong.

4. The invention in accordance with claim 3 wherein the hammer supporting plate is pivotally mounted at one end to the piston plate and at its other end to a fixed support such that it is adapted to pivot about the fixed support in response to oscillation of the piston plate.

5. The invention in accordance with claim 3 wherein an elastic means extends between the hammer supporting plate and the hammer to cooperate in reducing impact forces incident to the striking of the hammer on the gong.

6. The invention in accordance with claim 3 wherein elastic means are provided between the hammer and the hammer supporting plate to cooperate in effectively increasing the stroke of the hammer and consequently its impact on the gong.

7. The invention in accordance with claim 1 wherein the spring means includes a coil spring.

8. The invention in accordance with claim 1 wherein the spring means includes a leaf spring.

* * * * *

REEXAMINATION CERTIFICATE (1409th)

United States Patent [19]

Sakaguchi

[11] B1 4,183,018

[45] Certificate Issued Jan. 29, 1991

[54] MOTOR DRIVEN TYPE GONG STRIKING MECHANISM

[76] Inventor: Mitsuo Sakaguchi, Tokyo, Japan

Reexamination Request:
No. 90/002,018, May 7, 1990

Reexamination Certificate for:

| | |
|---|---|
| Patent No.: | 4,183,018 |
| Issued: | Jan. 8, 1980 |
| Appl. No.: | 891,601 |
| Filed: | Mar. 30, 1978 |

[30] Foreign Application Priority Data

Dec. 6, 1977 [JP] Japan ..... 52-163630
Dec. 6, 1977 [JP] Japan ..... 52-163631

[51] Int. Cl.[5] ..... G10K 1/064
[52] U.S. Cl. ..... 340/396; 116/152
[58] Field of Search ..... 340/396, 384 R, 384 E; 116/152, 148, 154

[56] References Cited

U.S. PATENT DOCUMENTS

| | | | |
|---|---|---|---|
| 559,437 | 5/1896 | Carpenter . | |
| 1,304,912 | 5/1919 | Shaffroth . | |
| 1,340,059 | 5/1920 | Munyon . | |
| 1,635,985 | 7/1927 | Davis | 340/398 |
| 2,522,664 | 9/1950 | Coleman . | |
| 2,972,139 | 2/1961 | Knutson . | |
| 3,076,960 | 2/1963 | Knutson . | |
| 3,945,340 | 3/1976 | Yanigisawa | 116/157 |
| 4,183,018 | 1/1980 | Sakaguchi | 340/396 |

*Primary Examiner*—D. M. Yasich
*Attorney, Agent, or Firm*—Keith D. Beecher

[57] ABSTRACT

In a motor driven type gong striking mechanism, the rotation of the main shaft of an electric motor is converted through a crank mechanism into the oscillation of a piston plate, a gong striking hammer is coupled through a spring to the piston so that the hammer is oscillated, and a gong is disposed in the range of oscillation of the hammer. Thus, as a result of the rotation of the motor, the hammer is oscillated to strike the gong provided in the stroke of the hammer.

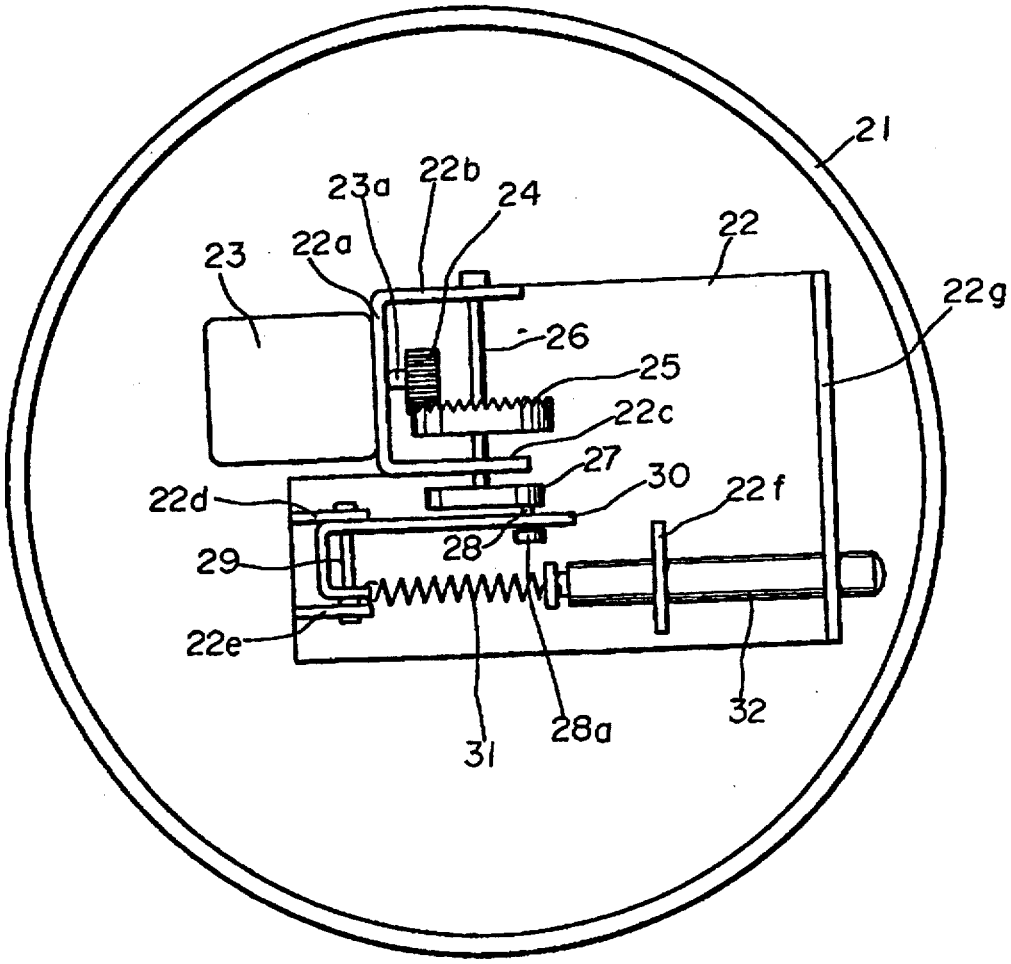

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–8 is confirmed.

* * * * *